United States Patent [19]

Fuhrman et al.

[11] 4,112,856

[45] Sep. 12, 1978

[54] ASH REMOVAL EQUIPMENT ARRANGED ON A LIFTING MECHANISM FOR PULVERIZED-COAL FURNACES OF LARGE-CAPACITY STEAM GENERATORS

[76] Inventors: Günther Georg Fuhrman, Im Lerchenrain 16, 7000 Stuttgart 1; Uwe Jonny Krogmann, Stöckhofstr. 26/1, 7250 Leonberg; Gerhard Wolfgang Schroth, Blautopfstr. 2, 7000 Stuttgart 61, all of Germany

[21] Appl. No.: 798,351

[22] Filed: May 19, 1977

[30] Foreign Application Priority Data

May 11, 1976 [DE] Fed. Rep. of Germany ..... 2620836

[51] Int. Cl.[2] ..... F23J 1/02

[52] U.S. Cl. ..... 110/165 R; 110/171

[58] Field of Search ..... 110/88, 89, 165 R, 171

[56] References Cited

U.S. PATENT DOCUMENTS

| | | | |
|---|---|---|---|
| 3,499,401 | 3/1970 | Wessberg | 110/89 |
| 3,693,558 | 9/1972 | Theoclitus | 110/89 |
| 3,931,773 | 1/1976 | Reimann | 110/171 |

*Primary Examiner*—Kenneth W. Sprague

[57] ABSTRACT

Ash removal equipment associated with pulverized coal furnaces for large-capacity steam generators having a chain conveyor disposed beneath the combustion chamber of the furnace immersed in water and having a protective hood preventing entry of outside air to the combustion chamber with hinged flaps by which the ash outlet of the combustion chamber can be closed off. With the coal furnace out of operation, the ash removal equipment can be elevated so that the hinged flaps are immersed in the water and can be lowered or raised during operation of the coal furnace relative to the position of the ash outlet.

6 Claims, 5 Drawing Figures

Figures 1, 2, 3, 4, 5:
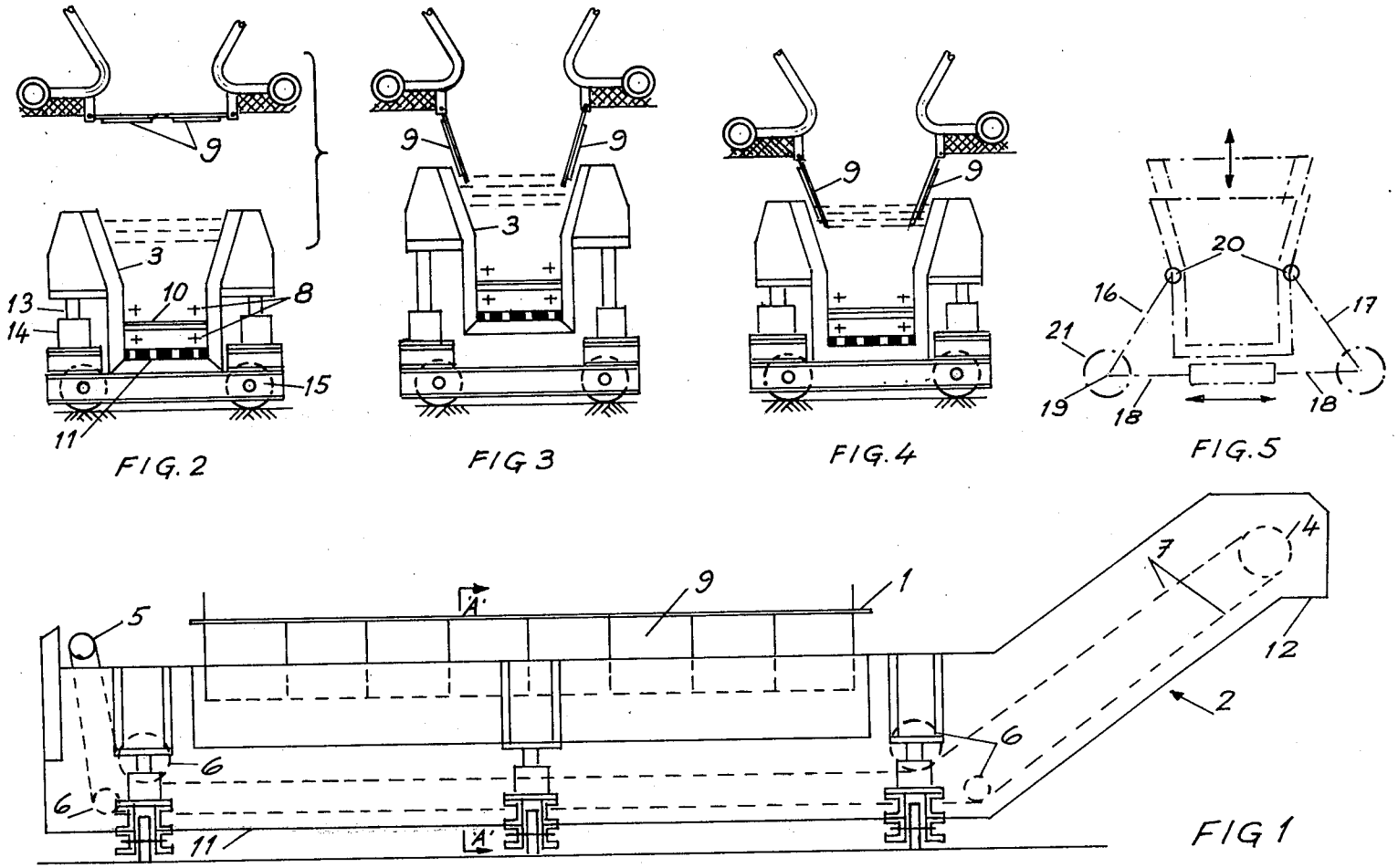

ASH REMOVAL EQUIPMENT ARRANGED ON A LIFTING MECHANISM FOR PULVERIZED-COAL FURNACES OF LARGE-CAPACITY STEAM GENERATORS

The invention relates to an ash removal equipment arranged on a lifting mechanism for pulverized-coal furnaces of large-capacity steam generators with a scraper chain conveyor arranged underneath the top-suspended, cooling tube-lined combustion chamber and a protective hood which starts at the slot-like outlet of the combustion chamber, prevents the entry of outside air to the combustion chamber, is freely immersed in a water supply of the scraper chain conveyor and which consists of hinged flaps by which the ash outlet of the combustion chamber can be closed off.

From the German Pat. No. 12 98 229, an ash removal equipment is known, with a scraper chain conveyor arranged underneath the combustion chamber and a protective hood which starts at the slot-like ash outlet of the combustion chamber, prevents the entry of outside air to the combustion chamber and is freely immersed in water supply of the conveyor, the protective hood consisting of hinged flaps by which the ash outlet of the combustion chamber can be closed off.

The use of such ash removal equipments in modern large-capacity steam generators, which are customarily suspended at their upper end, causes difficulties as the ash outlet of the combustion chamber is lowered as much as 700 mm during operation due to thermal expansion. With further increasing steam generator capacity, this lowering becomes still larger. As the hinged flaps which form the protective hood must meet in the center of the ash outlet slot when they are swung in, but must be immersed at the same time in the water supply of the ash removal equipment under any operating conditions of the steam generator, this means that the hinged flaps must have a length of about 1500 mm and the ash outlet slot, accordingly, a width of about 1600 to 1800 mm. As a consequence, not only does very heavy heat radiation take place onto the hinged flaps of the protective hood during the operation of the pulverized coal furnace, which causes them to warp, but much heat is also radiated on the water supply of the scraper chain conveyor. This leads to continuous loss of water and to a lowering of the efficiency, as the evaporated water reduces the combustion chamber temperature and increases the amount of waste gas.

It is an object of the invention to provide an ash removal equipment in which the width of the ash outlet can be held as small as possible and the short, hinged flaps resulting therefrom are immersed in the water supply under all operating conditions.

According to the invention, this problem is solved by the provision that the ash removal equipment, with the pulverized coal furnace out of operation, can be elevated by means of the lifting mechanism so far that the open hinged flaps are immersed in the water supply of the scraper chain conveyor, and that the ash removal equipment can be lowered or raised according to the lowering of the ash outlet during the operation of the pulverized coal furnace.

From the German Published Prosecuted Patent Application No. 12 86 255, an ash removal equipment, particularly for steam generators, is known, in which a scraper chain revolves in a trough which is arranged underneath the ash funnel of the furnace and can be moved transversely to the ash funnel and which is filled with quenching water in which the ash funnel outlet is immersed, the quenching water trough being supported on several pistons which can be moved in associated cylinders pneumatically or hydraulically.

In the ash removal equipment described, the protective hood consists not of hinged flaps, but of a closed casing. To move the ash removal equipment for repair or similar purposes, it was necessary in earlier designs to partially remove either the protective hood, or one side wall of the ash removal equipment. To avoid this disadvantage, the lifting device was provided, which permitted to lower the ash removal equipment so far that the upper edge of the quenching water trough was situated below the lower edge of the protective hood.

In a further embodiment of the invention, the lifting height of the lifting mechanism corresponds to the maximum lowering of the ash outlet during the operation of the coal furnace.

So that the required amount of lift can always be set as a function of the lowering, the cylinder/piston combinations of the lifting mechanism are connected to an automatic control, according to the invention.

According to the invention, the lifting mechanism is further arranged vertically on the undercarriage for the scraper chain conveyor, which is supported on its piston rods.

In another embodiment of the invention, the trough for the water supply of the scraper chain conveyor is supported on hinged rods which engage at the axles of the undercarriage, the axle spacing being variable parallel to the travel direction by means of the cylinder/piston combination.

Embodiment examples of the invention are shown in the drawing and will be described in greater detail in the following.

FIG. 1 shows a side view of the ash removal equipment;

FIG. 2, a cross section through the ash removal equipment according to the line A—A in FIG. 1 — steam generator in the rest position;

FIG. 3, a cross section through the ash removal equipment according to line A—A in FIG. 1 — steam generator in the operating condition;

FIG. 4, cross section through the ash removal equipment according to line A—A in FIG. 1, steam generator in operating condition, and FIG. 5, a schematic cross section through the ash removal equipment in another embodiment.

According to FIG. 1, a scraper chain conveyor 2 is arranged underneath the ash outlet 1 of the pulverized coal-fired steam generator. The scraper chain conveyor consists of a trough 3 which is filled with quenching water. Inside the trough 3, a pair of endless chains 7, which are connected to each other by scrapers 8, revolves over drive pulleys 4, reversing pulleys 5 and guide pulleys 6. From the ash outlet 1, the ash drops into the trough 3 through the protective hood formed by the hinged flaps 9. Upon entering the water, the ash is quenched. It falls on an intermediate bottom 10 and is first transported by the scrapers 8 of the upper side in the direction toward the reversal end of the scraper chain conveyor. At the end of the intermediate bottom 10, it falls to the bottom 11 of the trough 3, is engaged there by the scrapers 8 of the lower side and transported to the outlet 12. On both of its long sides, the trough 3 is supported by a row each of cylinder/piston combinations 13, 14, which are arranged vertically on the undercarriage 15.

In the ash removal equipment shown in FIG. 5, the trough 3 is supported on hinged rods 16, which engage the trough 3 at 20 and are connected to the axles 19 of the undercarriage 21. The cylinder/piston combinations 17–18 engage at the axles 19.

We claim:

1. In ash removal equipment for a high capacity steam generator using pulverized coal as fuel, said steam generator being of the type which is top suspended and includes a combustion chamber having an elongated bottom ash discharge outlet suspended over a water containing ash quenching trough extending along the underside of said outlet through which a submerged scraper chain conveyor arrangement is disposed for delivering the quenched ash externally for disposal, said bottom ash discharge outlet further including pairs of hinged trap doors disposed along said ash discharge outlet and movable from a closed position with their free ends meeting to close off said discharge outlet to an open substantially vertical downard hanging position where their free ends are submerged in said water and the doors form a protective hood along the sides of said trough to prevent entry of outside air into said combustion chamber, the improvement comprising adjustable lifting means supporting said trough for varying the relative vertical distance between said trough and the free ends of said trap doors when the latter are in said open position and for maintaining said free ends submerged in said water.

2. In ash removal equipment according to claim 1 said lifting means being vertically adjustable to an extent corresponding to the maximum lowering of the ash discharge outlet due to thermal expansion thereof during operation of said steam generator.

3. In ash removal equipment according to claim 2 said lifting means comprised of a plurality of hydraulic cylinder/piston rod combinations disposed at spaced positions along and connection to the sides of said trough and constituting the support thereof.

4. In ash removal equipment according to claim 3, said cylinders mounted in vertical positions along the underside of said trough and said trough being supported on said piston rods.

5. In ash removal equipment according to claim 1, automatic control means interconnecting said ash discharge outlet and said lifting means for maintaining a preselected said relative vertical distance between said trough and said free ends of said trap doors during operation of said steam generator.

6. In ash removal equipment according to claim 1, said lifting means comprising pairs of angularly disposed support rods hingedly affixed at their upper ends to said trough at spaced positions along opposite sides thereof, a pair of axle members, each disposed along an opposite side below said trough, the lower ends of said rods pivotally attached to a respective one of said axles, double cylinder/piston means interconnecting said axle members for varying the lateral distance between the same to vertically adjust said trough through said support rods.

* * * * *